US011793702B2

(12) United States Patent
Svintozelsky

(10) Patent No.: US 11,793,702 B2
(45) Date of Patent: Oct. 24, 2023

(54) GATES WITH TRANSITION RAMPS FOR OVERHEAD LIFTING RAILS

(71) Applicant: Liko Research & Development AB, Luleå (SE)

(72) Inventor: Samuel Svintozelsky, Batesville, IN (US)

(73) Assignee: Liko Research & Development AB, Luleå (SE)

( * ) Notice: Subject to any disclaimer, the term of this patent is extended or adjusted under 35 U.S.C. 154(b) by 878 days.

(21) Appl. No.: 16/597,196

(22) Filed: Oct. 9, 2019

(65) Prior Publication Data

US 2020/0113763 A1 Apr. 16, 2020

Related U.S. Application Data

(60) Provisional application No. 62/744,801, filed on Oct. 12, 2018.

(51) Int. Cl.
*A61G 7/10* (2006.01)

(52) U.S. Cl.
CPC ..... *A61G 7/1042* (2013.01); *A61G 7/1034* (2013.01); *A61G 7/1046* (2013.01)

(58) Field of Classification Search
CPC .. A61G 7/1042; A61G 7/1034; A61G 7/1046; B66C 7/12
USPC ..... 238/12
See application file for complete search history.

(56) References Cited

U.S. PATENT DOCUMENTS 1,612,217 A * 12/1926 Phillips ..... B65G 9/006 414/611
1,640,344 A 8/1927 Bennington
1,750,802 A * 3/1930 Haferkorn ..... B61L 23/002 104/100
1,841,454 A 1/1932 Robertson
3,011,455 A * 12/1961 Heimann ..... B60P 3/05 104/96

(Continued)

FOREIGN PATENT DOCUMENTS

CH 373881 A 12/1963
DE 19511035 A1 10/1996

(Continued)

OTHER PUBLICATIONS

Extended European Search Report dated Sep. 26, 2017 for EP Patent Application No. 16201815.4.

(Continued)

*Primary Examiner* — Justin C Mikowski
*Assistant Examiner* — Luke Hall
(74) *Attorney, Agent, or Firm* — Dinsmore & Shohl LLP

(57) ABSTRACT

A gate system that includes a first gate that couples to a first rail, the first rail partially defining a travel path for a lifting carriage and the first gate including a first ramp having a slope that is angled relative to the first rail when coupled thereto. The system includes a second gate that couples to a second rail, the second rail partially defining the travel path for the lifting carriage and the second gate including a second ramp having a slope that is angled relative to the second rail when coupled thereto. The first ramp and the second ramp provide a switch location when coupled to the first rail and the second rail where the lifting carriage translates between the first rail and the second rail.

20 Claims, 6 Drawing Sheets

(56) References Cited

U.S. PATENT DOCUMENTS 3,780,663 A * 12/1973 Pettit ..... A61G 7/1042 119/857
4,336,757 A * 6/1982 Toder ..... E05D 15/0608 104/96
4,372,452 A * 2/1983 McCord ..... B66C 19/00 212/331
4,453,051 A * 6/1984 Brown ..... B60M 1/32 403/14
5,177,822 A * 1/1993 Kassai ..... A61G 7/1053 5/81.1 R
5,490,293 A 2/1996 Nilsson
5,499,408 A * 3/1996 Nix ..... A61G 7/1061 5/85.1
6,475,076 B1 * 11/2002 Rheingans ..... A22C 21/0023 452/167
6,523,195 B1 2/2003 Rodier et al.
6,708,622 B2 3/2004 Bergeron
7,748,326 B2 7/2010 Simmons et al.
8,104,731 B2 1/2012 Faucher et al.
8,458,827 B2 6/2013 Darrow
8,650,675 B2 2/2014 Imhoff
8,850,635 B2 10/2014 Darrow
2002/0014568 A1 * 2/2002 Faucher ..... B66C 7/02 104/126
2003/0140816 A1 * 7/2003 Bergeron ..... B66C 7/14 5/81.1 R
2007/0289845 A1 * 12/2007 Takano ..... B65G 1/0457 198/465.4
2009/0199335 A1 * 8/2009 Guldmann ..... A61G 7/1015 5/87.1
2009/0293757 A1 12/2009 Bischofberger
2010/0219256 A1 * 9/2010 Williams ..... H01R 13/6205 238/14.05
2010/0288155 A1 * 11/2010 Chepurny ..... A61G 7/1042 104/89
2012/0000876 A1 * 1/2012 Bergenstrale ..... B61B 3/02 212/336
2012/0014627 A1 * 1/2012 Rehage ..... A47B 88/493 384/49
2012/0110731 A1 5/2012 Hand
2014/0346745 A1 * 11/2014 Ganel ..... A61G 5/1091 280/47.4
2015/0122194 A1 * 5/2015 De La Rosa ..... A01K 15/025 335/205
2015/0166084 A1 6/2015 Brannstrom et al.
2016/0054124 A1 * 2/2016 Schaefer ..... G01C 9/32 33/365
2016/0083912 A1 * 3/2016 Andre ..... E01B 7/28 246/381
2017/0012387 A1 * 1/2017 Williams ..... H01R 13/6205
2017/0137264 A1 5/2017 Bough-Sorensen et al.
2017/0194181 A1 7/2017 Chen et al.
2017/0292661 A1 * 10/2017 Moioli ..... F21V 15/01
2019/0234024 A1 * 8/2019 Frisbie ..... B61L 7/08

FOREIGN PATENT DOCUMENTS

DE 10218555 A1 5/2003
DE 102006011570 A1 9/2007
DE 2013004372 A1 9/2013
DE 102013004372 A1 9/2013
EP 0924835 A2 6/1999
EP 0940134 B1 7/2004
FR 2236770 A1 2/1975
GB 703061 A 1/1954
GB 711857 A 7/1954
GB 2418195 A 3/2006
GB 2659475 A 10/2017
GB 2549749 A 11/2017
JP 2006076756 A 3/2006
WO 2005084602 A1 9/2005
WO 2013122538 A1 8/2013
WO 2013179386 A1 12/2013
WO WO2013179386 A1 * 12/2013 ..... B66C 9/16
WO 2016004953 A1 1/2016

OTHER PUBLICATIONS

European Search Report filed in Application No. 17204710.2-1113; dated Apr. 25, 2018.
First Office Action dated Jun. 9, 2020 relating to Chinese Application No. 201921699017.5.
European Search Report dated Feb. 28, 2020 filed in European Application No. 19201764.8-1113.

* cited by examiner

GATES WITH TRANSITION RAMPS FOR OVERHEAD LIFTING RAILS

CROSS-REFERENCE

This application claims the benefit of and priority to U.S. Provisional Patent Application Ser. No. 62/744,801, titled Gates with Transition Ramps for Overhead Lifting Rails, filed Oct. 12, 2018, the details of which are incorporated by reference as if fully set forth herein.

FIELD

The present disclosure generally relates to gates and gate systems for overhead lifting rails, and in particular to gates and gate systems including ramps for interconnecting misaligned rails for use in healthcare facilities for lifting and moving patients from one rail to another rail.

TECHNICAL BACKGROUND

Caregivers may need to move patients from one location to another in a care facility. Sometimes, caregivers use lift systems to assist with lifting and/or moving a patient. The lift systems generally comprise overhead rails, both stationary and movable, and lifting carriages. While various lift systems and ancillary components have been developed, there is still room for improvement. In particular, a pair of adjacent rails may be partially misaligned with one another such that the lift carriage may experience difficulty traversing between the rails. In some instances, the adjacent rail sections may be offset in a horizontal direction, such that a horizontal gap is formed between the rails, and/or in a vertical direction such that one rail may be positioned at a higher elevation relative to an adjacent rail. Rail misalignments may be formed by installation variation and/or rail deflection. In either instance, the lift system may likely encounter an impediment when encountering a switch location between the misaligned rails which may cause added patient movement within the lift carriage.

Accordingly, a need exists for providing a gate system that includes a rail transition ramp for facilitating movement of a lift carriage across overhead rails that are misaligned at a switch location, thereby providing a smooth transition for the lift system despite the presence of misaligned rail sections.

SUMMARY

In one embodiment, a gate system includes a first gate that couples to a first rail, the first rail partially defines a travel path for a lifting carriage and the first gate includes a first ramp having a slope that is angled relative to the first rail when coupled thereto. The system includes a second gate that couples to a second rail, the second rail partially defines the travel path for the lifting carriage and the second gate includes a second ramp having a slope that is angled relative to the second rail when coupled thereto. The first ramp and the second ramp provide a switch location when coupled to the first rail and the second rail where the lifting carriage translates between the first rail and the second rail.

In another embodiment, a method of traversing a lifting carriage between a first rail portion and a second rail portion, the first rail portion is coupled to a first gate of a gate system and the second rail portion is coupled to a second gate of the gate system. The method comprises translating the lifting carriage along a travel path of the first rail portion toward the switch location, the first rail portion is misaligned with the second rail portion such that the travel path of the first rail portion is vertically offset from a travel path of the second rail portion at the switch location. The method comprise guiding the lifting carriage along a first ramp of the first gate, the first ramp extends vertically relative to the travel path of the first rail portion such that the lifting carriage translates along an angled travel path of the first ramp. The method further comprises receiving the lifting carriage at a second ramp of the second gate such that the lifting carriage translates through the switch location, and guiding the lifting carriage along the second ramp and toward the second rail portion. The second ramp extends vertically relative to the travel path of the second rail portion such that the lifting carriage translates along an angled travel path of the second ramp. The method comprises translating the lifting carriage along the travel path of the second rail portion.

In yet another embodiment, an overhead lifting rail system includes a first rail for supporting a lifting carriage that terminates at a first end and a second rail for supporting the lifting carriage that terminates at a second end. The first rail is misaligned with the second rail such that an impediment is formed at a switch location between the first end and the second end. The system includes a gate system comprising a first gate coupled to the first rail, the first rail partially defines a travel path for a lifting carriage and includes a first ramp having a slope that is angled relative to the travel path of the first rail. The gate system further comprises a second gate coupled to the second rail, the second rail partially defines the travel path for the lifting carriage and includes a second ramp having a slope that is angled relative to the travel path of the second rail. The first ramp and the second ramp provide a switch location between the first rail and the second rail where the lifting carriage translates between the first rail and the second rail.

Additional features of the gate system described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
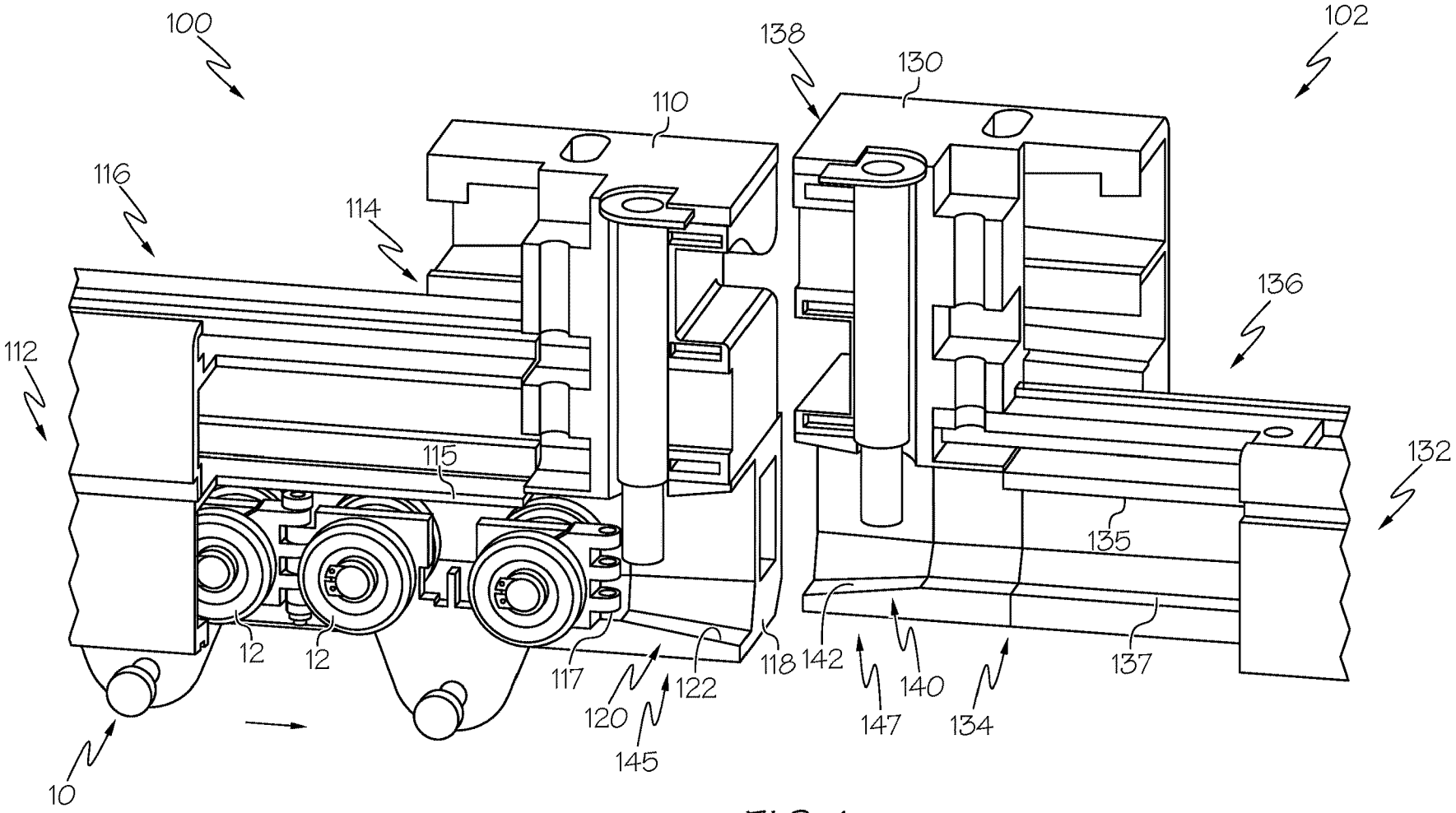
FIG. 1 depicts a perspective view of half of a gate system including a pair of gates according to one or more embodiments shown and described herein.

Reference will now be made in detail to embodiments of gate systems, examples of which are illustrated in the accompanying drawings. Whenever possible, the same reference numerals will be used throughout the drawings to refer to the same or like parts. Embodiments described herein are directed to overhead lifting systems for lifting and moving patients in healthcare facilities and methods for operating the same will be described herein with specific reference to the appended drawings.

As used herein, the term "overhead lifting rail system" refers to a system of fixed and movable rails, mounted overhead either to the ceiling or between walls. The movable rails, referred to herein as "traverse rails," enable patient transfers perpendicular to a travel direction of the fixed rails. Fixed rails are used where only movement along a fixed travel direction is required, for example over a patient bed, in bathrooms, or in corridors of the healthcare facility. Traverse rails enable movement of the traverse rails in a direction transverse to the fixed direction between fixed rails. Typically, the traverse rails travel along their own tracks and connect to the fixed rails. The present gate system enables the two types of rails to be engaged to form a continuous rail, thus enabling the lifting carriage to move from the fixed rail to the traverse rail, or vice versa. Other types of rail components are also envisaged, including turntable switches, where fixed rails are coupled together with a rotatable turntable for selecting the desired pathway for the lifting carriage, and side rail switches for selecting between two fixed rails.

As used herein, the terms "vertical", "horizontal", "above", "below", "top", and "bottom", refer to the directions and relative positions of components associated with the gate system when mounted to, and supported by, a ceiling or between two walls. The gate system of the present disclosure enables coupling of two rail portions of an overhead rail system, where at least one rail portion is movable in a direction perpendicular to the travel direction of the other.

Referring initially to FIG. 1, a gate system 100 is coupled to an overhead lifting rail system 102 that is mounted to a ceiling, such as, for example, the ceiling of a patientcare room. As will be described in greater detail herein, the gate system 100 provides a bridge that is positioned between adjacent rails of the overhead lifting rail system 102 to enable and promote relatively smooth running of a lifting carriage 10 through the gate system 100 when there is a misalignment between the rails of the overhead lifting rail system 102. The overhead lifting rail system 102 includes at least a first rail 116 and a second rail 136, among other further guide rails, mounted to the ceiling. The first rail 116 extends along a longitudinal length defined between a first end 112 and a second end 114, defining a longitudinal axis and travel direction of the first rail 116. The first rail 116 is sized and shaped to slidably receive a lifting carriage 10 therein, and in particular, one or more wheels 12 of the lifting carriage 10. The first rail 116 defines a first support surface 117 that is parallel to the longitudinal length of the first rail 116. The first support surface 117 provides for a longitudinal slot for the wheels 12 of the lifting carriage 10 to be received in and to translate along when the lifting carriage 10 traverses through the first rail 116 of the overhead lifting rail system 102 in the travel direction.

The rail system 102 further includes the second rail 136 extending along a longitudinal length defined between a first end 132 and a second end 134, defining a longitudinal axis and travel direction of the second rail 136. The second rail 136, similar to the first rail 116, is sized and shaped to slidably receive the lifting carriage 10 therein, and in particular, one or more wheels 12 of the lifting carriage 10. The second rail 136 defines a second support surface 137 that is parallel to the longitudinal length of the second rail 136. The second support surface 137 provides for a longitudinal slot for the wheels 12 of the lifting carriage 10 to be received in and to translate along when the lifting carriage 10 traverses through the second rail 136 of the overhead lifting rail system 102.

In some embodiments, either the first rail 116, the second rail 136, and/or both rails 116, 136 may be a traverse rail in that the one or more of the rails 116, 136 are capable of traversing (i.e., moving) perpendicularly relative to the corresponding rail 116, 136. In particular, either the first rail 116 or the second rail 136 is mounted to the ceiling by further guide rails which enable movement of the traverse rail perpendicularly or otherwise relative to the longitudinal length of the rail. In this instance, the traverse rail is operable to move along the ceiling that the overhead lifting rail system 102 is mounted to. In some embodiments, at least one of the first rail 116 or the second rail 136 may be a fixed rail (i.e., stationary) such that one or more of the rails 116, 136 is incapable of traversing relative to the ceiling and the corresponding rail 116, 136 in the travel direction.

In the present example, the first rail 116 is a traverse rail and is configured to move along the ceiling, and the second rail 136 is a fixed rail that is fixedly secured to the ceiling. In this instance, the first rail 116 may move toward the second rail 136 to thereby align and couple the first support surface 117 with the second support surface 137. As will be described in greater detail below, one or more rails 116, 136 of the overhead lifting rail system 102 may be misaligned with one another such that an offset is formed between the support surfaces 117, 137 when the rails 116, 136 are coupled together.

The gate system 100 includes a first gate 110 and a second gate 130 coupled to the overhead lifting rail system 102 along the first and second rails 116, 136, respectively. In particular, the first gate 110 is coupled to the first rail 116 at the second end 114. It should be understood that, in some embodiments, the first gate 110 may be coupled to the first rail 116 at the first end 112 in lieu of the second end 114 and/or in addition to the second end 114 such that the first rail 116 may include multiple gates 110 coupled thereon. The first gate 110 includes a first engagement face 118 spaced longitudinally from the second end 114. The first engagement face 118 is sized and shaped to couple the first gate 110 with a corresponding engagement face of a complimentary gate that is attached to another rail portion of the overhead lifting rail system 102.

It should be understood that the rear face (i.e., a back end) of the first gate 110, opposite of the engagement face 118, may include recessed portions and/or fastening mechanisms for receiving and mounting the first rail 116 to the first gate 110. In particular, the rear face of the first gate 110 may be sized and shaped to receive a standard rail size, such as H70 (i.e., a rail height of 70 mm), H100 (i.e., a rail height of 100 mm), H140 (i.e., a rail height of 140 mm), and/or the like.

Similarly, the second gate 130 is coupled to the second rail 136 at the second end 134. It should be understood that, in some embodiments, the second gate 130 may be coupled to the second rail 136 at the first end 132, rather than at the second end 134, and/or in addition to the second end 134 such that the second rail 136 may include multiple gates 130 coupled thereon. The second gate 130 includes a second engagement face 138 spaced longitudinally from the second end 134. The second engagement face 138 is sized and shaped to couple the second gate 130 with a corresponding engagement face of a complimentary gate that is attached to another rail portion of the overhead lifting rail system 102.

It should be understood that the rear face (i.e., a back end) of the second gate 130, opposite of the engagement face 138, may include recessed portions and/or fastening mechanisms for receiving and mounting the second rail 136 to the second gate 130. It should also be understood that gates 110, 130 are configured and operable to be interchangeable such that the first rail 116 may include the second gate 130 coupled thereon and the second rail 136 may include the first gate 110 coupled thereon.

With the first gate 110 and the second gate 130 coupled to the first rail 116 and the second rail 136, respectively, an increased weight may be generated upon the overhead lifting rail system 102. In some embodiments, the first gate 110 and the second gate 130 may be formed of a metal having a relatively light weight to effectively minimize the load applied onto the overhead lifting rail system 102 through the attachment of the first gate 110 and the second gate 130 onto the rails 116, 136. For example, the first and second gates 110, 130 may be formed of aluminum, as compared to steel, to provide a lighter composition for the gate system 100 which thereby reduces the increased weight of the overhead lifting rail system 102 when coupled to the gate system 100.

The first and second engagement faces 118, 138 of the first and second gate 110, 130, respectively, are sized and shaped to engage one another to thereby couple the first and second gates 110, 130 together when the first rail 116 is aligned with the second rail 136. It should be understood that the engagement faces 118, 138 of the first and second gates 110, 130 may include one or more fastening mechanisms positioned thereon that are configured and operable to releasably attach the first gate 110 to the second gate 130. For example, the first and second gate 110, 130 may include at least one magnet along the first and second engagement faces 118, 138 that are capable of magnetically attracting the corresponding magnet to thereby align and couple the first rail 116 of the first gate 110 to the second rail 136 of the second gate 130. In this instance, it should be understood that the engagement faces 118, 138 of the gates 110, 130 may include magnets comprising opposite polarizations to thereby attract the corresponding magnet on the opposing engagement face 118, 138 of the other gate 110, 130, respectively. The magnets may maintain the gates 110, 130 in the aligned configuration until an operator of the gate system 100 moves the first rail 116 (i.e., the traverse rail) relative to the second rail 136 (i.e., the fixed rail).

Still referring to FIG. 1, with the second end 114 of the first rail 116 positioned adjacent to the second end 134 of the second gate 130, the first engagement face 118 of the first gate 110 is aligned with the second engagement face 138 of the second gate 130 for the first gate 110 to couple with the second gate 130. However, in this instance, the first support surface 117 of the first rail 116 is misaligned with the second support surface 137 of the second rail 136. Misaligned rails 116, 136 may be caused by various factors, including but not limited to, variations in installation of the overhead lifting rail system 102, and in particular the respective rails 116, 136, deflection of the rails 116, 136 based on current loads received (e.g., when the lifting carriage 10 is presently lifting a patient) along the rails 116, 136, respectively, and/or wear experienced along one or more of the rails 116, 136 due to endured use of the rail system 102 supporting various loads. As will be described in greater detail below, misalignment of the support surfaces 117, 137 of the rails 116, 136 may define a gap between the engagement faces 118, 138 of the first and second gates 110, 130.

Accordingly, with the first and second rails 116, 136 misaligned when the first and second gates 110, 130 are coupled together at the first and second engagement faces 118, 138, the wheels 12 of the lifting carriage 10 are inhibited from freely translating across the rails 116, 136 without encountering an obstruction at the switch location between the gates 110, 130. For example, with the lifting carriage 10 received within the first rail 116 between the first and second ends 112, 114, the wheels 12 of the lifting carriage 10 may experience an obstruction in the form of a physical impediment when translating from the first rail 116 to the second rail 136.

Figure 2:
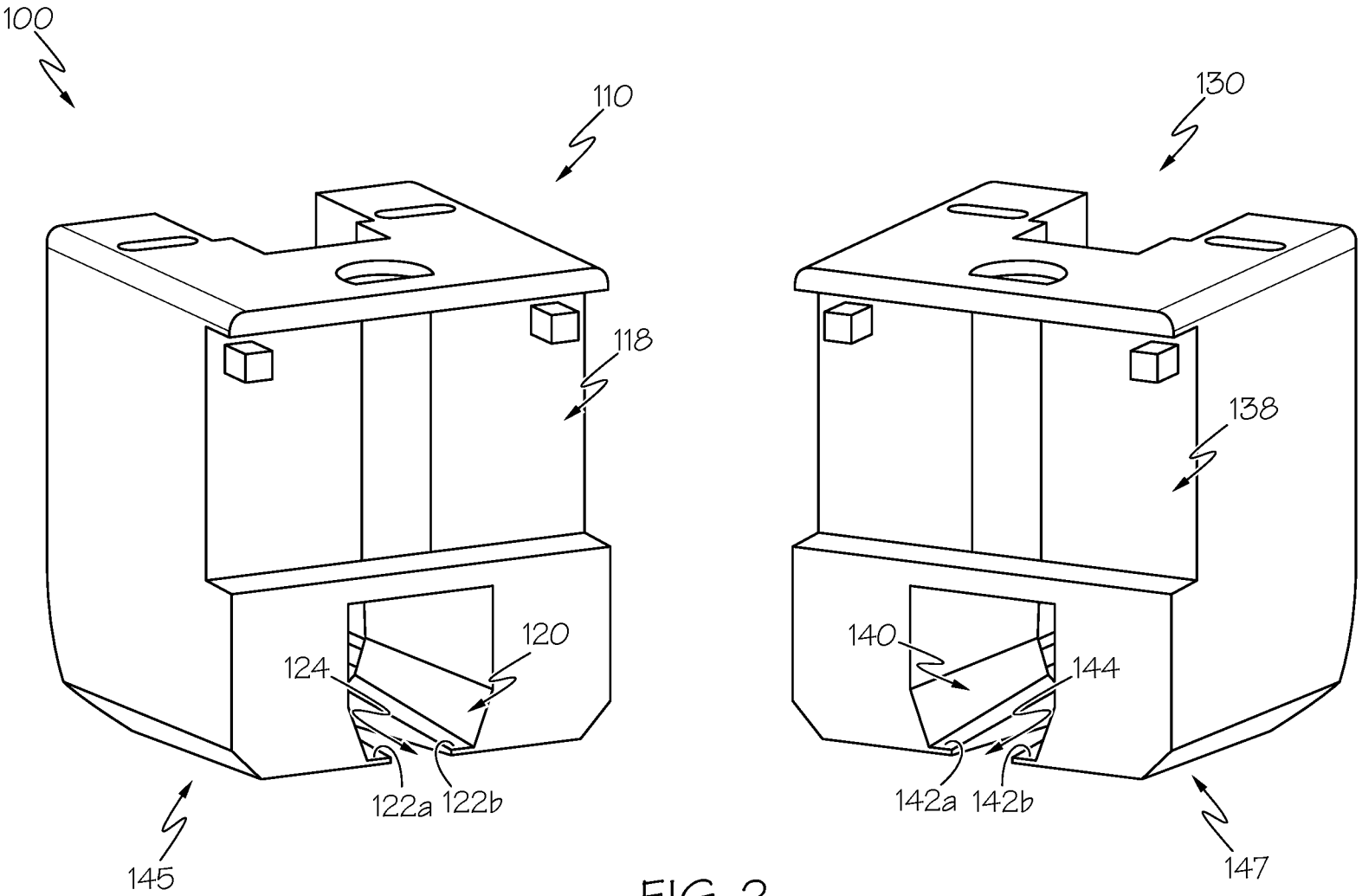
FIG. 2 depicts a perspective view of the pair of gates of FIG. 1 including ramps with cammed support surfaces according to one or more embodiments shown and described herein.

Referring also to FIG. 2, the first gate 110 includes a first ramp 120 extending between opposite ends of the first gate 110. In particular, the first ramp 120 extends from the second end 114 of the first rail 116 to the first engagement face 118 of the first gate 110. The first ramp 120 defines a first cammed support surface 122 that is sized and shaped to receive the wheels 12 of the lifting carriage 10 therein, similar to the support surfaces 117, 137 of the rails 116, 136. In particular, the first cammed support surface 122 of the first ramp 120 is defined by a pair of tapered ledges 122*a*, 122*b* extending through the first gate 110 between the opposing ends of the first gate 110. The pair of tapered ledges 122*a*, 122*b* are offset from one another by a slot 124 disposed therebetween such that the pair of tapered ledges 122*a*, 122*b* defines the slot 124 extending through a center portion of the first ramp 120. Each of the pair of tapered ledges 122*a*, 122*b* include a lateral width that is sized and shaped to support at least one wheel 12 of the lifting carriage 10 thereon. It should be understood that in the present example the pair of tapered ledges 122*a*, 122*b* of the first ramp 120 are sloped between the opposing ends of the first gate 110 at corresponding angles such that the pair of tapered ledges 122*a*, 122*b* extend along a parallel plane with one another. Accordingly, the pair of tapered ledges 122*a*, 122*b* collectively defines an angled travel path of the first ramp 120.

With the first ramp 120 coupled to the first rail 116 at the second end 114, the first cammed support surface 122 may be interconnected with the first support surface 117 of the first rail 116. As will be described in greater detail below, the first ramp 120 is capable of reducing an impediment formed between the second ends 114, 134 of the first and second rails 116, 136 when the support surfaces 117, 137 of the rails 116, 136 are misaligned. In particular, the first cammed support surface 122 has a slope that is angled relative to the longitudinal length of the first support surface 117 such that the first ramp 120 extends from the second end 114 of the first rail 116 at an angle.

Similarly, the second gate 130 includes a second ramp 140 extending between opposing ends of the second gate 130. In particular, the second ramp 140 extends from the second end 134 of the second rail 136 to the second engagement face 138 of the second gate 130. The second ramp 140 defines a second cammed support surface 142 that is sized and shaped to receive the wheels 12 of the lifting carriage 10 therein. In particular, the second cammed support surface 142 of the second ramp 140 is defined by a pair of tapered ledges 142*a*, 142*b* extending through the second gate 130 between the opposing ends of the second gate 130. Each of the pair of tapered ledges 142*a*, 142*b* are offset from one another by a slot 144 disposed therebetween such that the pair of tapered ledges 142*a*, 142*b* defines the slot 144 extending through a center portion of the second ramp 140. Each of the pair of tapered ledges 142*a*, 142*b* include a lateral width that is sized and shaped to support (i.e., receive) at least one wheel 12 of the lifting carriage 10 thereon. It should be understood that in the present example the pair of tapered ledges 142*a*, 142*b* of the second ramp 140 are sloped between the opposing ends of the second gate 130 at corresponding angles such that the pair of tapered ledges 142*a*, 142*b* extend along a parallel plane with one another. Accordingly, the pair of tapered ledges 142*a*, 142*b* collectively defines an angled travel path of the second ramp 140.

With the second gate 130 coupled to the second rail 136, the second cammed support surface 142 may be interconnected with the second support surface 137 of the second rail 136. The second ramp 140 is capable of reducing an impediment formed between the second ends 114, 134 of the first and second rails 116, 136 when the support surfaces 117, 137 of the rails 116, 136 are misaligned. In particular, the second cammed support surface 142 has a slope that is angled relative to the longitudinal length of the second support surface 137 such that the second ramp 140 extends from the second end 134 of the second rail 136 at an angle.

Still referring to FIG. 2, the first and second gates 110, 130, and in particular the engagement faces 118, 138 of the gates 110, 130, are shown separated from one another for ease of reference, but as will be appreciated, in use the engagement faces 118, 138 are configured to couple against one another. The first ramp 120 extends relatively downward toward an underside 145 of the first gate 110. As can be seen, a downstream portion of the first cammed support surface 122 adjacent to the first engagement face 118 is positioned relatively lower than an opposing upstream portion of the first cammed support surface 122 opposite of the first engagement face 118. Similarly, in correspondence with the shape of the first ramp 120, the second ramp 140 extends relatively downward an underside 147 of the second gate 130 such that an upstream portion of the second cammed support surface 142 adjacent to the second engagement face 138 is positioned relatively lower than an opposing downstream portion of the second cammed support surface 142 opposite of the second engagement face 138. The dimensions forming the profile of the first and second ramps 120, 140 may serve to minimize the impediments formed between adjacent, misaligned rails 116, 136 of the overhead lifting rail system 102.

Figure 3:
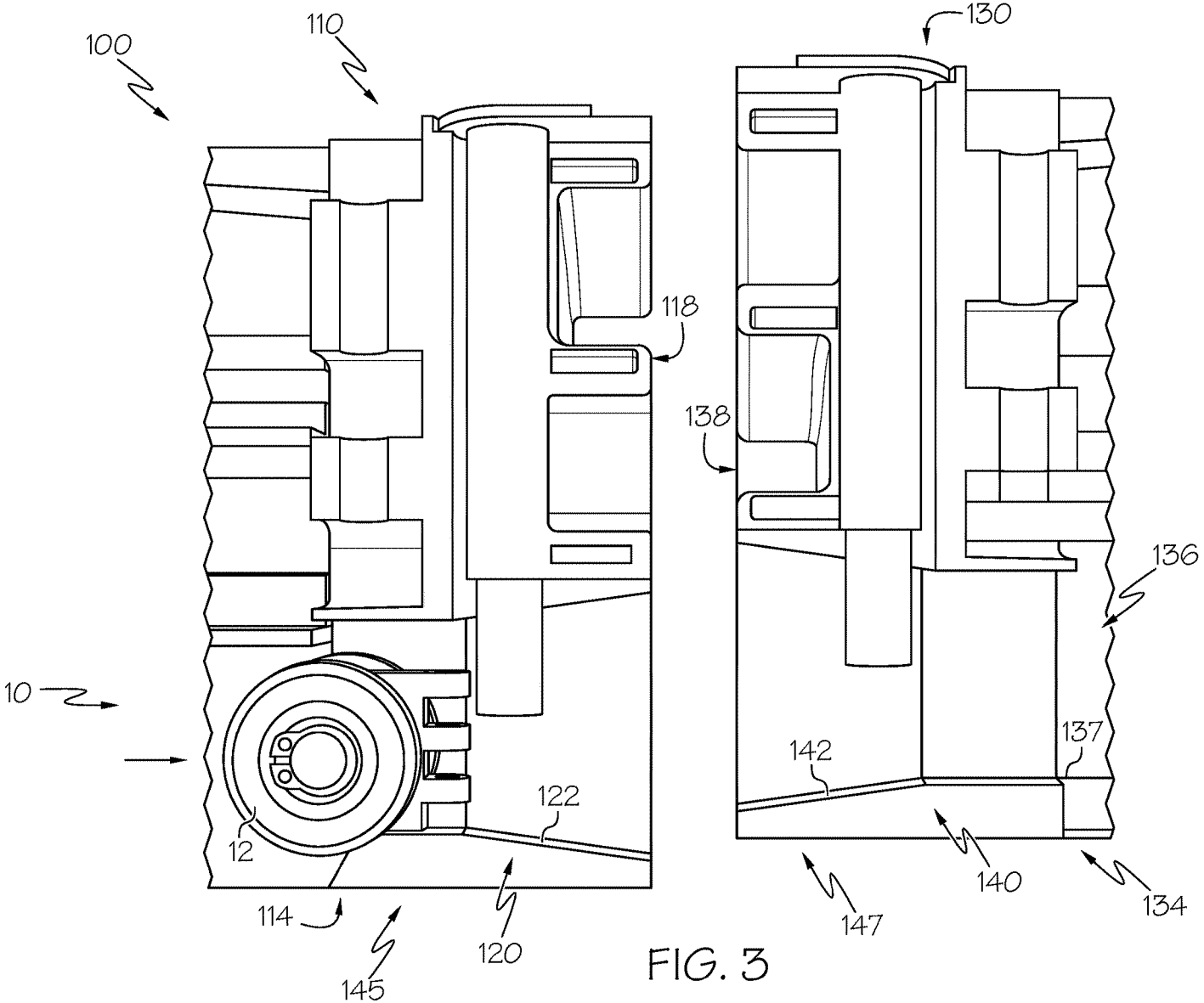
FIG. 3 depicts a side section view of halves of the pair of gates of FIG. 1 coupled together with the ramps extending toward one another according to one or more embodiments shown and described herein.
Figure 4:
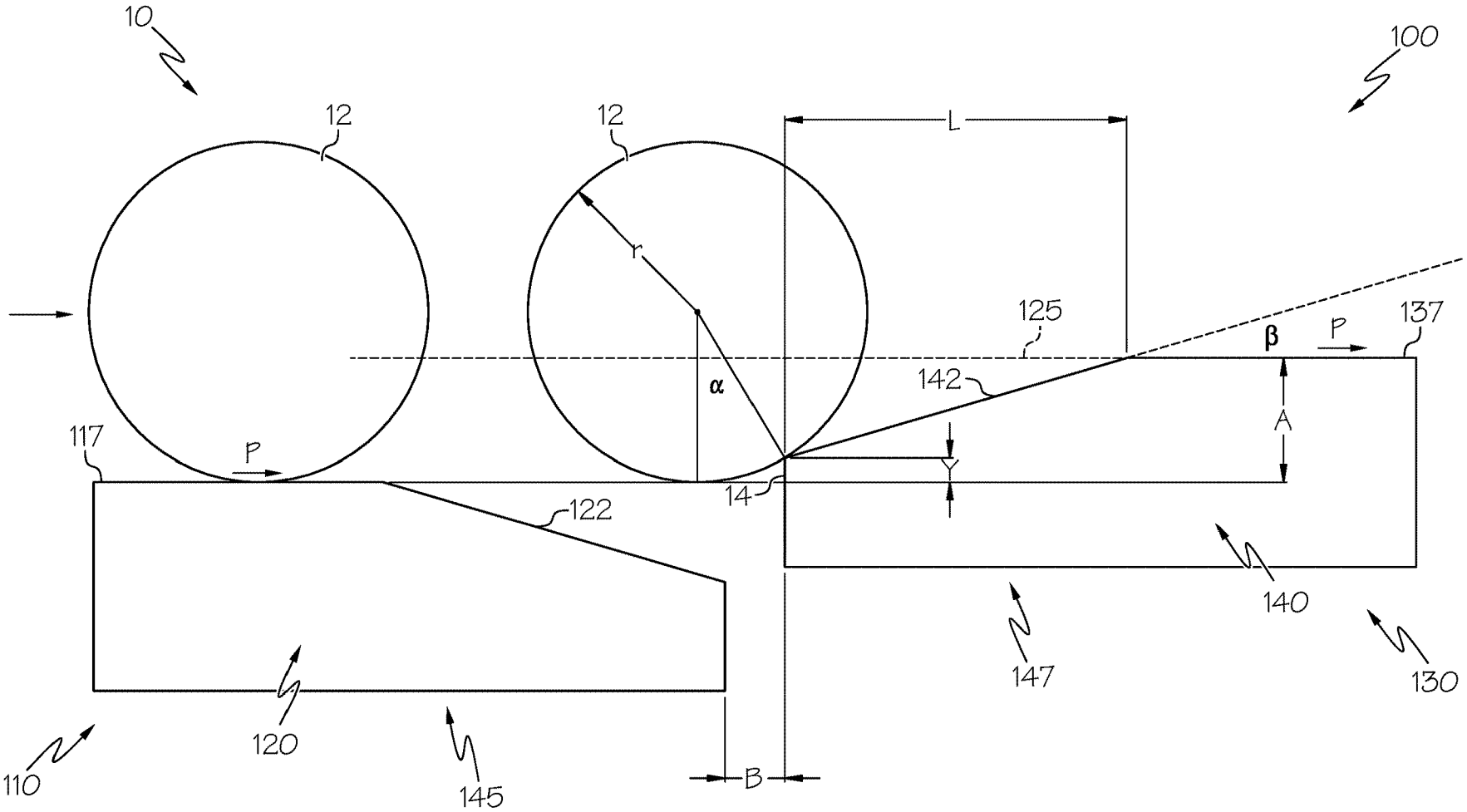
FIG. 4 schematically depicts a wheel of a lifting carriage traversing between the ramps of the pair of gates of FIG. 1 according to one or more embodiments shown and described herein.

Referring to FIGS. 3 and 4, in exemplary use, the first rail 116 (i.e., the traverse rail) may be traversed along the ceiling until aligning with the second rail 136 (i.e., the fixed rail). With the gates 110, 130 coupled to the second ends 114, 134, of the rails 116, 136, respectively, the first rail 116 may be coupled to the second rail 136 via the engagement of the first gate 110 and the second gate 130 along the engagement faces 118, 138 (such as through the engagement of one or more magnets positioned thereon). With the gates 110, 130 coupled together, a lifting carriage 10 is free to traverse the rails 116, 136 from the first rail 116 to the second rail 136 or vice versa. In this instance, the second rail 136 of the rail system 102 is misaligned with the first rail 116 by a vertical offset A. In particular, the second rail 136 is positioned at a relatively higher elevation than the first rail 116 such that the first support surface 117 is not in alignment with the second support surface 137. The misalignment of the overhead lifting rail system 102 further includes a horizontal gap B formed between the engagement faces 118, 138 such that the gates 110, 130 are separated by the horizontal gap B. It should be understood that, in other embodiments, the first rail 116 may be positioned at a relatively higher elevation than the second rail 136.

The wheels 12 of the lifting carriage 10 may translate across the first rail 116 of the rail system 102 toward the second end 114 (FIG. 3). In this instance, with the first rail 116 coupled to the first gate 110 at the second end 114, the support surface 117 defined by the first rail 116 is interconnected with the first cammed support surface 122 of the first ramp 120 such that the first wheel 12 may translate through the first ramp 120 as the lifting carriage 10 advances beyond the second end 114 of the first rail 116.

Referring to FIG. 4, a schematic illustration depicts the interaction between the wheels 12 of the lifting carriage 10 and the gates 110, 130 as the lifting carriage 10 travels across the first rail 116 and toward the second rail 136. In particular, as the lifting carriage 10 advances toward the engagement faces 118, 138 of the gates 110, 130, the first wheel 12 may become suspended in air upon reaching the first cammed support surface 122 of the first ramp 120. The first wheel 12 may be maintained in the suspended state due to the continued engagement of the remaining wheels 12 of the lifting carriage 10 with the first support surface 117 of the first rail 116. In this instance, the first wheel 12 of the lifting carriage 10 is positioned above the first ramp 120 such that the first wheel 12 may not come into contact with the first cammed support surface 122. Rather, the first wheel 12 may move across the switch location between the first gate 110 and the second gate 130 as the remaining wheels 12 of the lifting carriage 10 continue to translate along the first support surface 117 of the first rail 116 and toward the second rail 136.

With the first rail 116 positioned relatively lower than the second rail 136, the first wheel 12 may encounter an impediment in the form of a step 14 when advancing toward the second gate 130. In particular, the step 14 may be a portion of the engagement face 138 of the second gate 130 that is positioned in alignment with the first support surface 117 of the first rail 116. The size Y of the step 14 that the wheels 12 of the lifting carriage 10 may encounter at the switch location between the gates 110, 130 may be determined by various parameters as seen in FIG. 4. For example, the size Y of the step 14 may be based on parameters including, but not limited to, an offset distance A formed between the first support surface 117 of the first rail 116 and the second support surface 137 of the second rail 136, a ramp angle β that defines the slope of the second ramp 140 relative to the longitudinal axis 125, and/or a length L of the second cammed support surface 142 extending between the second support surface 137 and the second engagement face 138. In some embodiments, the ramp angle β may be between about 1 degree and about 45 degrees relative to the support surface 137 and the travel path P defined by the support surface 137.

Variations of the parameters may affect size Y of the step 14 that the wheels 12 of the lifting carriage 10 may or may not encounter. As merely an illustrative example, the size Y of the step 14 may be reduced or even eliminated when the second ramp 140 is formed to define a greater ramp angle β with the travel path P that thereby extends the second cammed support surface 142 vertically downward to an extent substantially equivalent to or greater than the offset distance A between the first support surface 117 of the first rail 116 and the second support surface 137 of the second rail 136. Providing a ramp angle β that extends the second cammed support surface 142 below the support surface 117 can eliminate the step 14 and provide less agitation as the lifting carriage 10 moves over the switch location. It should be understood that the relative dimensions of the first and second ramps 120, 140, and in particular the cammed support surfaces 122, 142, are such that the wheels 12 of the lifting carriage 10 are substantially aligned with and supported along at least one support surface as the lifting carriage 10 traverses through the gate system 100.

Figure 5:
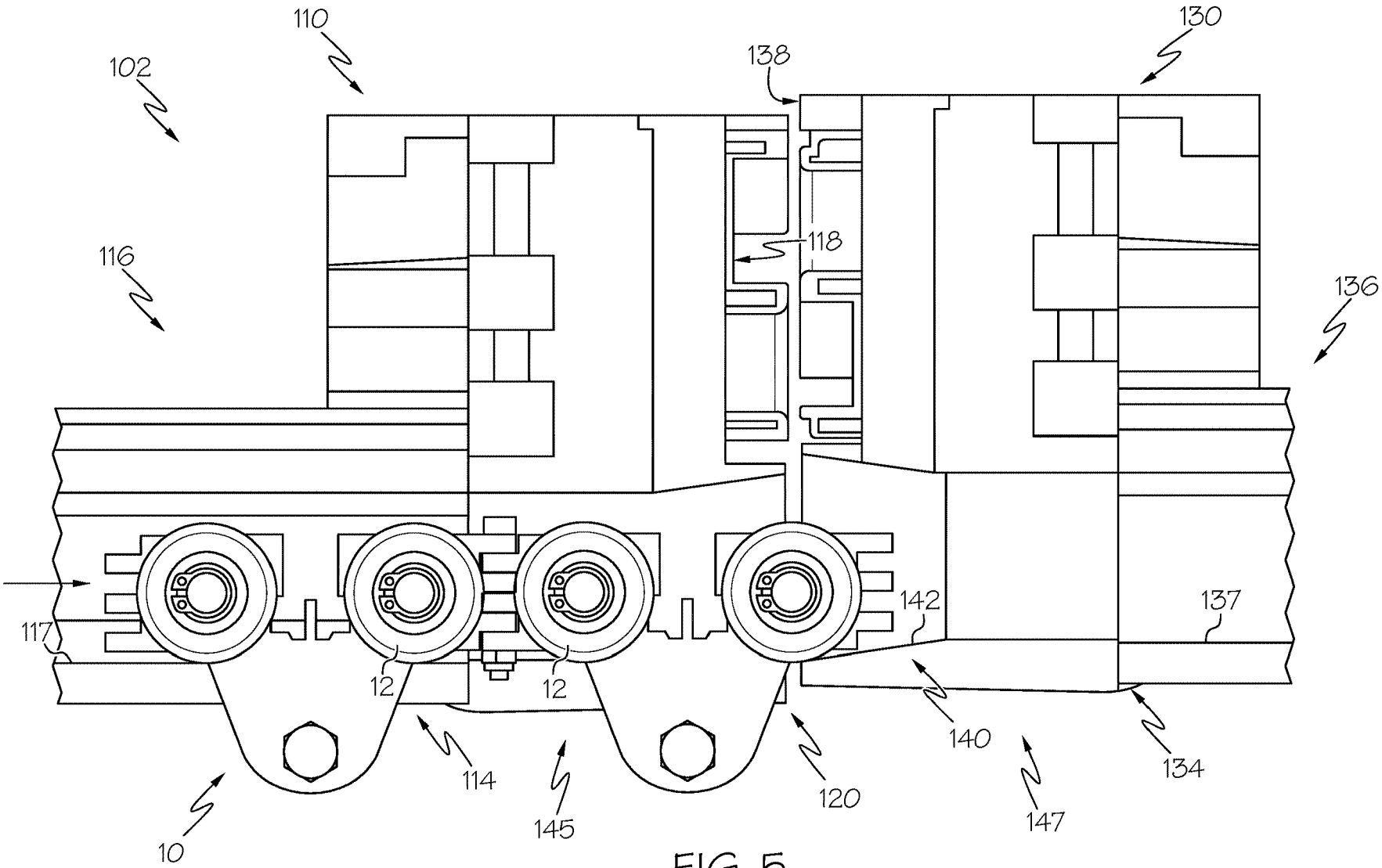
FIG. 5 depicts a side section view of a series of wheels of a lifting carriage traversing across the rails and ramps of the pair of gates of FIG. 1 according to one or more embodiments shown and described herein.

Referring to FIG. 5, as the lifting carriage 10 continues to advance through the switch location between the gates 110, 130, the first wheel 12 may translate over the step 14 and onto the second ramp 140, thereby advancing the lifting carriage 10 through the switch location and toward the second rail 136. In this instance, the size Y of the step 14 encountered by the wheels 12 of the lifting carriage 10 is less than the vertical offset A between the support surfaces 117, 137 of the adjacent rails 116, 136 due to the position of the ramps 120, 140 on the first and second gates 110, 130, respectively. Accordingly, the lifting carriage 10 experiences a smaller obstruction (i.e., step 14) when traveling along the overhead lifting rail system 102 and requires less force to advance through the misaligned rails 116, 136. With the size Y of the step 14 minimized or even eliminated, the degree of impact generated upon the lifting carriage 10 when the wheels 12 of the lifting carriage 10 encounter the step 14 at the switch location is reduced or even eliminated. Therefore, the gate system 100 has the advantage of reducing the force required to push the lifting carriage 10 over any steps 14 in the rail caused by misalignment, and also reduces noise, and wear on the system.

As the lifting carriage 10 traverses through the overhead lifting rail system 102, the first wheel 12 translates along the second cammed support surface 142 while the remaining wheels 12 continue to translate along the first support surface 117 of the first rail 116. Ultimately, the first wheel 12 may translate along the length L of the second ramp 140 until reaching the second support surface 137 of the second rail 136. In this instance, a second wheel 12 of the lifting carriage 10 may arrive at the juncture between the first and second gates 110, 130 to thereby be received by the second ramp 140 at the second gate 130.

Alternatively, the lifting carriage 10 may travel in the opposite direction, with the wheels 12 of the lifting carriage 10 initially received within the second rail 136, rather than the first rail 116 as described above. In this instance, with the wheels 12 of the lifting carriage 10 received along the second support surface 137, the lifting carriage 10 may advance toward the first support surface 117 in a substantially similar process as described above except for the differences explicitly noted herein. For instance, with the second rail 136 positioned relatively higher than the first rail 116, the wheels 12 of the lifting carriage 10 may not encounter an impediment at the switch location between the gates 110, 130 as the second support surface 137 is elevated relative to the first support surface 117. Similarly, the second cammed support surface 142 is positioned above the first cammed support surface 122 due to the relative positions of the gates 110, 130 coupled to the rails 116, 136, respectively.

Figure 6:
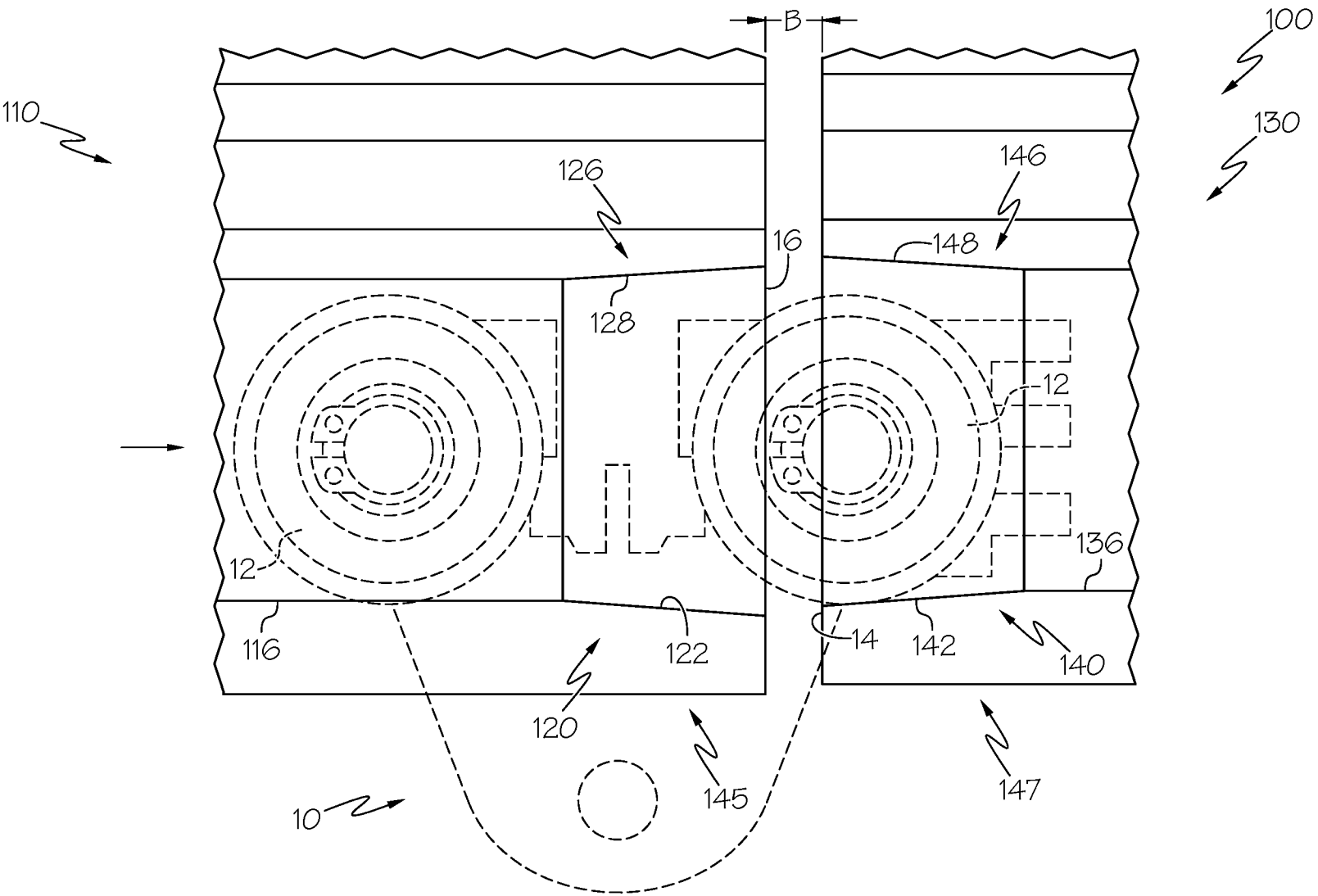
FIG. 6 depicts a detail side section view of a wheel of a lifting carriage traversing onto the ramp of the gate of FIG. 1 according to one or more embodiments shown and described herein.

Referring to FIG. 6, in some embodiments, the first gate 110 and the second gate 130 each include an upper ramp 126, 146, respectively, positioned above the ramps 120, 140. The first and second upper ramps 126, 146 of the first and second gates 110, 130 define an upper cammed support surface 128, 148 that are sized and shaped to accommodate the wheels 12 of the lifting carriage 10. The upper cammed support surfaces 128, 148 of the gates 110, 130 are capable of interconnecting with an upper support surface 115, 135 of the rails 116, 136 when the gate system 100 is coupled to the overhead lifting rail system 102. In particular, the first and second rails 116, 136 include the upper support surfaces 115, 135 positioned relatively above and parallel with the first and second support surfaces 117, 137.

The upper support surfaces 115, 135 provide space for the lifting carriage 10 as the lifting carriage 10 traverses through the rails 116, 136. In particular, the upper support surfaces 115, 135 are positioned relative to the support surfaces 117, 137 to provide an adequate space to accommodate and receive the wheels 12 of the lifting carriage 10 along the rails 116, 136. Further, the upper support surfaces 115, 135 are sized relative to the support surfaces 117, 137 to securely enclose and maintain the wheels 12 along the rails 116, 136 as the lifting carriage 10 travels along the gate system 100 to inhibit the wheels 12 from exiting the gate system 100 along an intermediate portion of the rails 116, 136.

The upper cammed support surfaces 128, 148 of the first and second gates 110, 130 are sloped at an angle relative to the longitudinal length of the upper support surfaces 115, 135 such that the upper ramps 126, 146 extend from the upper cammed support surfaces 128, 148, respectively, at an angle. The upper ramps 126, 146 facilitate the translation of the wheels 12 through the switch location between the gates 110, 130 by reducing or even eliminating the offset between adjacent, misaligned rails 116, 136. In this instance, a second impediment in the form of an upper step 16 may be formed along the engagement faces 118, 138 due to the misalignment of the rails 116, 136. It should be understood that the upper ramps 126, 146 may be configured and operable in a similar manner as described above with respect to the first and second ramps 120, 140 of the gates 110, 130. Accordingly, the upper ramps 126, 146 may be sized and shaped to reduce the impact of the impediment formed by the step 16 at the switch location as the lifting carriage 10 traverses across the gate system 100.

It should now be understood that embodiments described herein are directed to a gate system that includes at least two ramps having angled ramps formed therein. The angled ramps define a cammed support surface that are sized and shaped to receive a lifting carriage therein, and in particular one or more wheels of a lifting carriage. The gate system, which may be coupled to corresponding rails of a rail system, may facilitate the conveyance of the lifting carriage through a switch location between rails that are not in substantial alignment with one another. In particular, the angled ramps of the gates are capable of minimizing the misalignment between the support surfaces of the rails to thereby minimize a force impact endured by the lifting carriage as the wheels advance across the switch location between the rails.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A gate system for an overhead rail lifting system, the gate system comprising:

a first gate that couples to a first rail, the first rail partially defines a travel path for a lifting carriage, the first gate includes a first ramp having a slope that is angled relative to the travel path of the first rail when coupled thereto and a first engagement face; and a second gate that couples to a second rail, the second rail partially defines the travel path for the lifting carriage, the second gate includes a second ramp having a slope that is angled relative to the travel path of the second rail when coupled thereto and a second engagement face having an opposite polarization than the first engagement face and configured to magnetically couple with the first engagement face such that the first and second engagement faces face each other;

wherein the first ramp and the second ramp provide a switch location when coupled to the first rail and the second rail where the lifting carriage is configured to translate between the first rail and the second rail.

2. The gate system of claim 1, wherein the first ramp extends downward at an angle relative to the travel path of the first rail when the first gate is coupled thereto such that the first gate defines a first angled travel path relative to the travel path of the first rail, and the second ramp extends downward at an angle relative to the travel path of the second rail when the second gate is coupled thereto such that the second gate defines a second angled travel path relative to the travel path of the second rail.

3. The gate system of claim 2, wherein the first angled travel path of the first ramp extends between the travel path of the first rail and the second ramp to the switch location.

4. The gate system of claim 1, wherein a ramp angle of the first ramp is between 1 degree to 45 degrees relative to the travel path of the first rail when the first gate is coupled thereto.

5. The gate system of claim 1, wherein the first ramp extends between opposing ends of the first gate at a constant slope relative to the travel path of the first rail when the first gate is coupled thereto.

6. The gate system of claim 1, wherein the first gate and the second gate are sized to suspend the lifting carriage.

7. The gate system of claim 6, wherein the first ramp and the second ramp are configured to support at least one wheel of the lifting carriage thereon.

8. The gate system of claim 7, wherein the first ramp and the second ramp are configured to facilitate translation of the at least one wheel through the switch location by extending downwardly from the travel paths of the first rail and the second rail when the first gate and the second gate are coupled to the first rail and the second rail, respectively.

9. The gate system of claim 7, wherein the first ramp comprises a pair of ledges with a slot formed between the pair of ledges, such that each of the ledges is offset from one another by the slot.

10. The gate system of claim 9, wherein each of the ledges defines a lateral width that is sized to receive at least one wheel of the lifting carriage thereon.

11. The gate system of claim 9, wherein the pair of ledges extends between opposing ends of the first ramp along a plane such that the pair of ledges collectively define an angled travel path of the first ramp.

12. The gate system of claim 1, wherein the first gate comprises an upper ramp that faces the first ramp.

13. A method of traversing a lifting carriage between a first rail portion and a second rail portion through a switch location provided therebetween, the first rail portion is coupled to a first gate of a gate system and the second rail portion is coupled to a second gate of the gate system, the method comprising:

magnetically coupling a first engagement face of the first gate and a second engagement face of the second gate, the second engagement face having an opposite polarization than the first engagement face and configured to magnetically couple with the first engagement face such that the first and second engagement faces face each other;

translating the lifting carriage along a travel path of the first rail portion toward the switch location, the first rail portion is misaligned with the second rail portion such that the travel path of the first rail portion is vertically offset from a travel path of the second rail portion at the switch location;

guiding the lifting carriage along a first ramp of the first gate, the first ramp extends downward at an angle relative to the travel path of the first rail portion such that the lifting carriage translates along an angled travel path of the first ramp;

receiving the lifting carriage at a second ramp of the second gate such that the lifting carriage translates through the switch location;

guiding the lifting carriage along the second ramp and toward the second rail portion, the second ramp extends downward at an angle relative to the travel path of the second rail portion such that the lifting carriage translates along an angled travel path of the second ramp; and translating the lifting carriage along the travel path of the second rail portion.

14. The method of claim 13, wherein receiving the lifting carriage at the second ramp comprises elevating the lifting carriage onto the second ramp at the switch location.

15. The method of claim 13, wherein the first gate comprises an upper support surface that faces the first ramp.

16. An overhead lifting rail system, comprising:

a first rail for supporting a lifting carriage that terminates at a first end;

a second rail for supporting the lifting carriage that terminates at a second end, wherein the first rail is misaligned with the second rail such that an impediment is formed at a switch location between the first end and the second end; and a gate system comprising:

a first gate coupled to the first rail, the first rail partially defines a travel path for a lifting carriage, the first gate includes a first ramp having a slope that is angled relative to the travel path of the first rail and a first engagement face; and a second gate coupled to the second rail, the second rail partially defines the travel path for the lifting carriage, the second gate includes a second ramp having a slope that is angled relative to the travel path of the second rail and a second engagement face having an opposite polarization than the first engagement face and configured to magnetically couple with the first engagement face such that the first and second engagement faces face each other;

wherein the first ramp and the second ramp provide a switch location between the first rail and the second rail where the lifting carriage translates between the first rail and the second rail.

17. The overhead lifting rail system of claim 16, wherein the first ramp extends downward at an angle relative to the travel path of the first rail such that the first gate defines a first angled travel path relative to the travel path of the first rail, and the second ramp extends downward at an angle relative to the travel path of the second rail such that the second gate defines a second angled travel path relative to the travel path of the second rail.

18. The overhead lifting rail system of claim 17, wherein the first angled travel path of the first ramp extends between the travel path of the first rail and the second ramp to the switch location.

19. The overhead lifting rail system of claim 16, wherein a ramp angle of the first ramp is between 1 degree to 45 degrees relative to the travel path of the first rail.

20. The overhead lifting rail system of claim 16, wherein the first ramp comprises a pair of ledges with a slot formed between the pair of ledges, such that each of the ledges is offset from one another by the slot.

* * * * *